US006578539B2

(12) United States Patent
Barbezat

(10) Patent No.: US 6,578,539 B2
(45) Date of Patent: Jun. 17, 2003

(54) SURFACE LAYER FORMING A CYLINDER BARREL SURFACE, A SPRAYING POWDER SUITABLE THEREFOR AND A METHOD OF CREATING SUCH A SURFACE LAYER

(75) Inventor: Gérard Barbezat, Opfikon (CH)

(73) Assignee: Sulzer Metco AG, Wohlen (CH)

( * ) Notice: Subject to any disclaimer, the term of this patent is extended or adjusted under 35 U.S.C. 154(b) by 0 days.

(21) Appl. No.: 09/855,471

(22) Filed: May 15, 2001

(65) Prior Publication Data

US 2002/0011243 A1 Jan. 31, 2002

(30) Foreign Application Priority Data

Jun. 14, 2000 (CH) ..... 1174/00

(51) Int. Cl.[7] ..... F02B 75/08; C22C 1/05
(52) U.S. Cl. ..... 123/193.4; 75/252; 428/553
(58) Field of Search ..... 123/193.4; 75/252; 428/553

(56) References Cited

U.S. PATENT DOCUMENTS 4,251,599 A * 2/1981 McCormick ..... 277/442
4,741,974 A * 5/1988 Longo et al. ..... 219/146.51
5,408,964 A * 4/1995 Rao ..... 123/193.2
5,882,801 A * 3/1999 Beardsley et al. ..... 428/570
6,090,497 A * 7/2000 Mori et al. ..... 428/641

FOREIGN PATENT DOCUMENTS

EP 0 607 779 A1 7/1994
EP 0 716 156 A1 6/1996
EP 1 022 351 A1 7/2000
GB 2 297 053 A 7/1996
GB 2 320 033 A 6/1998
JP 07317595 A * 12/1995 ..... B23K/10/00

OTHER PUBLICATIONS

Handbook Of Chemistry And Physics, 42 edition. Published by The Chemical Rubber Publishing Company. Pp 1543. Mar. 1961.*

Wegst, C.W. "Stahlschlüssel, 15th Edition" 1989, Verlag Stahlschlüssel Wegst GMBH, Marbach, pp. 4–5.

* cited by examiner

*Primary Examiner*—Noah P. Kamen
(74) *Attorney, Agent, or Firm*—Maginot, Moore & Bowman

(57) ABSTRACT

A surface layer for forming a cylinder barrel wall of a combustion engine block is proposed. The surface layer has separate phases of components that are separated from the phase of the remaining materials. The surface layer is produced by plasma spraying an iron containing spraying powder, incorporating all components of the layer to be produced. Such a surface layer may be applied easily and shows a significantly improved behavior regarding the machining thereof, without negatively influencing other important characteristics of the layer material, like wear resistance and coefficient of friction vis-à-vis the material of the piston rings. Preferred components of the spraying powder are, besides Fe, Cr, MN, S and C. Moreover, the spraying powder can contain As, Te, Se, Sb and/or Bi.

10 Claims, No Drawings

SURFACE LAYER FORMING A CYLINDER BARREL SURFACE, A SPRAYING POWDER SUITABLE THEREFOR AND A METHOD OF CREATING SUCH A SURFACE LAYER

BACKGROUND OF THE INVENTION

The present invention refers, in a first aspect, to a surface layer adapted to form a cylinder barrel surface of a combustion engine cylinder block, the surface layer comprising separate phases of components that are separated from the phase and phases, respectively, of the remaining surface materials. In a second respect, the invention refers to a spraying powder suitable for producing such a surface layer, and in a third aspect, the invention also refers to a method of producing a surface layer adapted to form a cylinder barrel surface.

PRIOR ART

A thermal coating of cylinder barrel surfaces by means of plasma spraying is known in the prior art, e.g. from the document EP-B1-0,716,156 entitled "Combustion Engine Block with Coated Cylinder Sleeves".

The machinability of such layers produced by plasma spraying by honing, lapping or grinding was limited up to now, with the result that the machining costs were relatively high, particularly as far as the machining time and the life span of the tools are concerned.

The machinability of such plasma spraying layers can be considerably improved by the addition of solid lubricating particles, for example by the addition of hexagonal boron nitride (BN), of $MoS_2$ or $WS_2$. Boron nitride or the mentioned sulfides, however, can be added to the layer only to a limited degree because the react with the oxygen of the ambient air or are corroded by the high temperature of the plasma. Thus, they have to be protected by costly envelopes.

Further, the document EP 99 81 1122.3 discloses a method of so-called "reactive spraying" in which, by means of controlled addition of oxygen during the plasma spraying process, FeO-(wustites) and $Fe_3O_4$-crystals (magnetite) are formed in the plasma spraying layer. Thereby, the coefficient of friction and the machinability are improved.

Finally, the document GB-A-2,297,053 discloses an insertable sleeve member for cylinder barrels that consist of a supereutectic aluminum/silicon-alloy. The sleeve member undergoes, after having been inserted into an engine block, a mechanical machining insofar as its surface is first coarsely and then finely machined. In a last phase of machining, the surface is honed. After the honing operation, those particles that are harder than the micro structure of the base alloy, particularly silicon crystals and intermetallic phases, slightly tower above the real surface of the sleeve member. By means of those exposed particles, the resistance to wear is said to be improved.

OBJECTS OF THE INVENTION

Based on that prior art, it is an object of the present invention to provide a surface layer forming a cylinder barrel surface that can be easily applied to the cylinder surface and that is considerably easier to machine, without negatively influencing other important characteristics of the layer material. In particular, the resistance to wear and the low coefficient of friction vis-à-vis the material of the piston rings cooperating with the surface layer shall be maintained or even improved.

It is a further object of the present invention to provide a spraying powder for producing surface layers having the above characteristics, and, finally, it is a still further object of the invention to provide a method of applying a surface layer having the above characteristics.

SUMMARY OF THE INVENTION

To meet these and other objects, the invention provides a surface layer adapted to form a cylinder barrel surface of a combustion engine cylinder block. The surface layer comprises separate phases of components that are separated from the phase and phases, respectively, of the remaining surface materials. The surface layer is formed by plasma spraying an iron containing spraying powder containing all components of the surface layer to be formed.

The surface layer can be applied either directly to a cylinder wall of an engine block, or to the wall of a cylinder sleeve member to be inserted in to the engine block.

Besides a predominant portion of iron, preferred further components of the coating powder are chrome, manganese, sulfur and carbon. Also suitable are bismuth, lead, tellurium and selenium. The afore mentioned materials can be added in their elementary form or in the form of compositions.

The above mentioned additions form the separate phases upon cooling of the surface layer applied by plasma spraying. Thereby, it is understood that the sprayed-on surface layer has the same composition as the spraying powder.

The spraying powder for producing a surface layer adapted to form a cylinder barrel surface of a combustion engine cylinder block comprises separate phases of components that are separated from the phase and phases, respectively, of the remaining surface materials. The surface layer is formed by plasma spraying the spraying powder, using a rotating plasmatron, whereby the spraying powder contains all components of the surface layer to be formed.

EXAMPLES

In the following, some examples of the spraying powder used to apply the surface layer according to the invention will be further described.

Example 1

A spraying powder, having a composition as indicated below, has been atomized by means of gas and applied to the inner wall of a combustion engine cylinder by plasma spraying:

| | |
|---|---|
| Cr = | 0.1% to 18.0% by weight |
| Mn = | 0.1% to 6.0% by weight |
| S = | 0.01% to 0.5% by weight |
| C = | 0.1% to 1.2% by weight |
| Fe = | difference to 100% by weight. |

Preferably, the spraying powder has the following composition:

| | |
|---|---|
| Cr = | 0.1% to 3.0% by weight |
| Mn = | 0.3% to 1.5% by weight |
| S = | 0.05% to 0.3% by weight |

-continued

| | |
|---|---|
| C = | 0.8% to 1.2% by weight |
| Fe = | difference to 100% by weight. |

Example 2

A spraying powder, having a composition as indicated below, has been atomized by means of gas and applied to the inner wall of a combustion engine cylinder by plasma spraying:

| | |
|---|---|
| Cr = | 12.0% to 15.0% by weight |
| Mn = | 0.3% to 1.5% by weight |
| S = | 0.05% to 0.3% by weight |
| C = | 0.35% to 0.6% by weight |
| Fe = | difference to 100% by weight. |

The thereby created coatings are resistant against corrosion, particularly under the impact of sulfuric acid and formic acid, i.e. under the impact of condensation products that can be formed in combustion engines.

The proposed surface layers as well as the proposed powders are particularly well suited for being applied directly to the inner cylinder walls of combustion engine blocks, particularly of engine blocks made of a light alloy. It is understood that also cylinder sleeves to be inserted into an engine block or already inserted into an engine block can be provided with the proposed surface layer. Preferably, the spraying powder is applied by means of a plasma spraying apparatus having a rotating plasmatron.

What is claimed is:

1. A spraying powder for producing a surface layer adapted to form a cylinder barrel surface of a combustion engine cylinder block, said surface layer comprising separate phases of components that are separated from the phase and phases, respectively, of the remaining surface materials, and said surface layer being formed by plasma spraying said spraying powder, said spraying powder containing all components of the surface layer to be formed and having the following composition:

| | |
|---|---|
| Cr = | 0.1% to 18.0% by weight |
| Mn = | 0.1% to 6.0% by weight |
| S = | 0.01% to 0.5% by weight |
| C = | 0.1% to 1.2% by weight |
| Fe = | difference to 100% by weight. |

2. A spraying powder according to claim 1, having the following composition:

| | |
|---|---|
| Cr = | 0.1% to 3.0% by weight |
| Mn = | 0.3% to 1.5% by weight |

-continued

| | |
|---|---|
| S = | 0.05% to 0.3% by weight |
| C = | 0.8% to 1.2% by weight |
| Fe = | difference to 100% by weight. |

3. A spraying powder according to claim 2, further containing one or more of the following components:

| | |
|---|---|
| As = | 0.001% to 0.01% by weight |
| Te = | 0.001% to 0.01% by weight |
| Se = | 0.001% to 0.01% by weight |
| Sb = | 0.001% to 0.01% by weight |
| Bi = | 0.001% to 0.01% by weight. |

4. A spraying powder according to claim 2, further containing 0.01% to 0.5% by weight Pb.

5. A spraying powder according to claim 1, for producing a surface layer having corrosion resistive properties under the impact of sulfuric acid and formic acid and having the following composition:

| | |
|---|---|
| Cr = | 12.0% to 15.0% by weight |
| Mn = | 0.3% to 1.5% by weight |
| S = | 0.05% to 0.3% by weight |
| C = | 0.35% to 0.6% by weight |
| Fe = | difference to 100% by weight. |

6. A spraying powder according to claim 5, further containing one or more of the following components:

| | |
|---|---|
| As = | 0.001% to 0.1% by weight |
| Te = | 0.001% to 0.1% by weight |
| Se = | 0.001% to 0.1% by weight |
| Sb = | 0.001% to 0.1% by weight |
| Bi = | 0.001% to 0.1% by weight. |

7. A spraying powder according to claim 5, further containing 0.01% to 0.5% by weight Pb.

8. A spraying powder according to claim 1, further containing one or more of the following components:

| | |
|---|---|
| As = | 0.001% to 0.1% by weight |
| Te = | 0.001% to 0.1% by weight |
| Se = | 0.001% to 0.1% by weight |
| Sb = | 0.001% to 0.1% by weight |
| Bi = | 0.001% to 0.1% by weight. |

9. A spraying powder according to claim 1, further containing 0.01% to 0.5% by weight Pb.

10. A spraying powder according to claim 8, further containing 0.01% to 0.5% by weight Pb.

* * * * *